US011319692B2

(12) United States Patent
Gerber

(10) Patent No.: US 11,319,692 B2
(45) Date of Patent: May 3, 2022

(54) RIPPER SHANK POCKET WITH WEAR INSERTS

(71) Applicant: Caterpillar Inc., Deerfield, IL (US)

(72) Inventor: Byron Lynn Gerber, Roanoke, IL (US)

(73) Assignee: Caterpillar Inc., Peoria, IL (US)

( * ) Notice: Subject to any disclaimer, the term of this patent is extended or adjusted under 35 U.S.C. 154(b) by 369 days.

(21) Appl. No.: 16/394,470

(22) Filed: Apr. 25, 2019

(65) Prior Publication Data

US 2020/0018038 A1 Jan. 16, 2020

Related U.S. Application Data

(60) Provisional application No. 62/698,351, filed on Jul. 16, 2018.

(51) Int. Cl.
*E02F 3/815* (2006.01)
*E02F 5/32* (2006.01)

(52) U.S. Cl.
CPC ..... *E02F 3/8152* (2013.01); *E02F 5/32* (2013.01)

(58) Field of Classification Search
CPC ... E02F 5/323; E02F 5/326; E02F 5/32; E02F 5/8152
See application file for complete search history.

(56) References Cited

U.S. PATENT DOCUMENTS 1,964,492 A * 6/1934 Yandell ..... F01C 21/0836 418/265
2,113,256 A * 4/1938 Jeanne ..... G03B 31/02 226/13
2,115,227 A * 4/1938 Kuchar ..... B62D 55/22 305/48
2,161,072 A * 6/1939 McKenney ..... B65D 9/34 217/69
2,284,178 A * 5/1942 Sublett ..... E02F 9/2875 172/702
2,670,199 A * 2/1954 Smith ..... F16F 7/08 267/49
3,412,977 A * 11/1968 Moyer ..... F01D 11/08 415/173.1
3,460,634 A 8/1969 Rheem
3,503,456 A 3/1970 Caterpillar
4,321,970 A 3/1982 Thigpen
4,453,600 A 6/1984 Thigpen
4,716,666 A * 1/1988 Potter ..... E02F 9/2883 37/398

(Continued)

*Primary Examiner* — Jessica H Lutz
(74) *Attorney, Agent, or Firm* — Law Office of Kurt J. Fugman LLC

(57) ABSTRACT

A ripper assembly is disclosed. The ripper assembly may include a ripper cross-member defining at least a first ripper shank pocket. The ripper cross member may include a front wall, a rear wall, a first side wall and a second side wall. The front wall may connect to the rear wall, to define a perimeter of the at least first ripper shank pocket, the front wall, the rear wall, the first side wall, and the second side wall, and to also define a longitudinal axis and a free end disposed along the longitudinal axis adjacent the perimeter of the at least first ripper shank pocket. At least one of the front wall, the rear wall, the first side wall and the second side wall may define a retention boss aperture and a retention mechanism pocket in communication with the retention boss aperture.

10 Claims, 10 Drawing Sheets

(56) References Cited

U.S. PATENT DOCUMENTS 4,995,176 A * 2/1991 Briscoe ..... E02F 3/8152 37/454
5,241,765 A * 9/1993 Jones ..... E02F 3/60 37/398
5,653,048 A * 8/1997 Jones ..... E02F 9/2825 37/452
5,913,605 A * 6/1999 Jusselin ..... E02F 9/2883 37/451
5,937,549 A * 8/1999 Bender ..... E02F 9/2825 37/455
5,992,023 A * 11/1999 Sederberg ..... E02F 3/965 30/134
6,194,080 B1 * 2/2001 Stickling ..... E02F 9/2841 172/772
7,080,470 B2 * 7/2006 Jones ..... E02F 9/2858 37/452
7,658,234 B2 2/2010 Caterpillar
7,793,444 B2 * 9/2010 Jones ..... E02F 9/2883 37/456
10,030,367 B2 * 7/2018 Dare ..... E02F 3/40
2003/0024139 A1 * 2/2003 Jones ..... E02F 9/28 37/456
2006/0225313 A1 * 10/2006 McClanahan ..... E02F 9/2833 37/450
2007/0044349 A1 * 3/2007 McClanahan ..... E02F 9/2883 37/452
2008/0092413 A1 * 4/2008 McClanahan ..... E02F 9/2841 37/451
2009/0199441 A1 8/2009 Caterpillar
2016/0369481 A1 * 12/2016 Hooijmans ..... E02F 9/2808
2017/0370076 A1 * 12/2017 Campomanes ..... E02F 9/2833
2019/0376263 A1 * 12/2019 Wood ..... E02F 9/2883
2021/0131077 A1 * 5/2021 Kunz ..... E02F 9/2883
2021/0156123 A1 * 5/2021 Gururaj ..... E02F 9/2833

* cited by examiner

RIPPER SHANK POCKET WITH WEAR INSERTS

CROSS-REFERENCE TO RELATED APPLICATIONS

This non-provisional application claims benefit of U.S. Provisional Patent Application Ser. No. 62/698,351, filed Jul. 16, 2018, and entitled "Ripper Shank Pocket with Wear Inserts", the contents of which are hereby incorporated by reference in their entirety.

TECHNICAL FIELD

The present disclosure relates to ripper assemblies employed by earth moving, construction and mining equipment and the like to break ground or other work surfaces. Specifically, the present disclosure relates to a ripper assembly that includes a ripper shank pocket with wear inserts that are attachable and detachable from ripper shank pocket.

BACKGROUND

Earth moving, construction and mining equipment and the like are often used in rough, off-road terrain. Such equipment, including bull dozers, may use ripper assemblies with pointed ripper members that are used to break the ground or other work material so that it can be more easily manipulated, moved, etc.

Over time or in heavy ripping applications, the force exerted at the point tips by the ground or work material as the pointed tips are dragged through the ground or other work material provides a moment or torque that tends to wear on the rear of the ripper shank pocket that holds the shank of the pointed ripper members. As a result, the ripper shank pocket may become worn and elongated, allowing for greater shank movement of the pointed ripper members during normal operation. This may lead to greater stress being exerted on shank of the ripper members. Consequently, either the shank or the pocket wall may become fatigued, necessitating replacement of various components.

U.S. Pat. No. 4,453,600 to Thigpen discloses what appears to be a wear insert disposed in the shank pocket of a ripper assembly between the rear wall of the shank pocket and the shank of the ripper member (see FIG. 4). However, Thigpen fails to disclose a retention mechanism for holding the wear insert in the ripper shank pocket. Consequently, the wear insert may fall out of the ripper shank pocket, creating increased play of the shank of the ripper member in the ripper shank pocket, exacerbating the aforementioned problems.

SUMMARY

A ripper assembly according to an embodiment of the present disclosure comprises a ripper cross-member defining at least a first ripper shank pocket, the ripper cross member including a front wall, a rear wall, a first side wall and a second side wall connecting the front wall to the rear wall, defining the perimeter of the at least first ripper shank pocket, the front wall, the rear wall, the first side wall, and the second side wall also defining a longitudinal axis and a free end disposed along the longitudinal axis adjacent the perimeter of the at least first ripper shank pocket. At least one of the front wall, the rear wall, the first side wall and the second side wall defining a retention boss aperture and a retention mechanism pocket in communication with the retention mechanism pocket.

A wear insert according to an embodiment of the present disclosure comprises a front surface, a rear surface, a top surface, a bottom surface, a first side surface, a second side surface, a first retention boss, and a first blend surface connecting the top surface to the front surface.

A wear insert comprising according to another embodiment of the present disclosure includes a front surface, a rear surface, a top surface, a bottom surface, a first side surface connecting the front surface to the rear surface and connecting the top surface to the bottom surface, a second side surface connecting the front surface to the rear surface and connecting the top surface to the bottom surface, and a first retention boss extending from the first side surface.

BRIEF DESCRIPTION OF THE DRAWINGS

The accompanying drawings, which are incorporated in and constitute a part of this specification, illustrate several embodiments of the disclosure and together with the description, serve to explain the principles of the disclosure. In the drawings.

DETAILED DESCRIPTION

Figure 1:
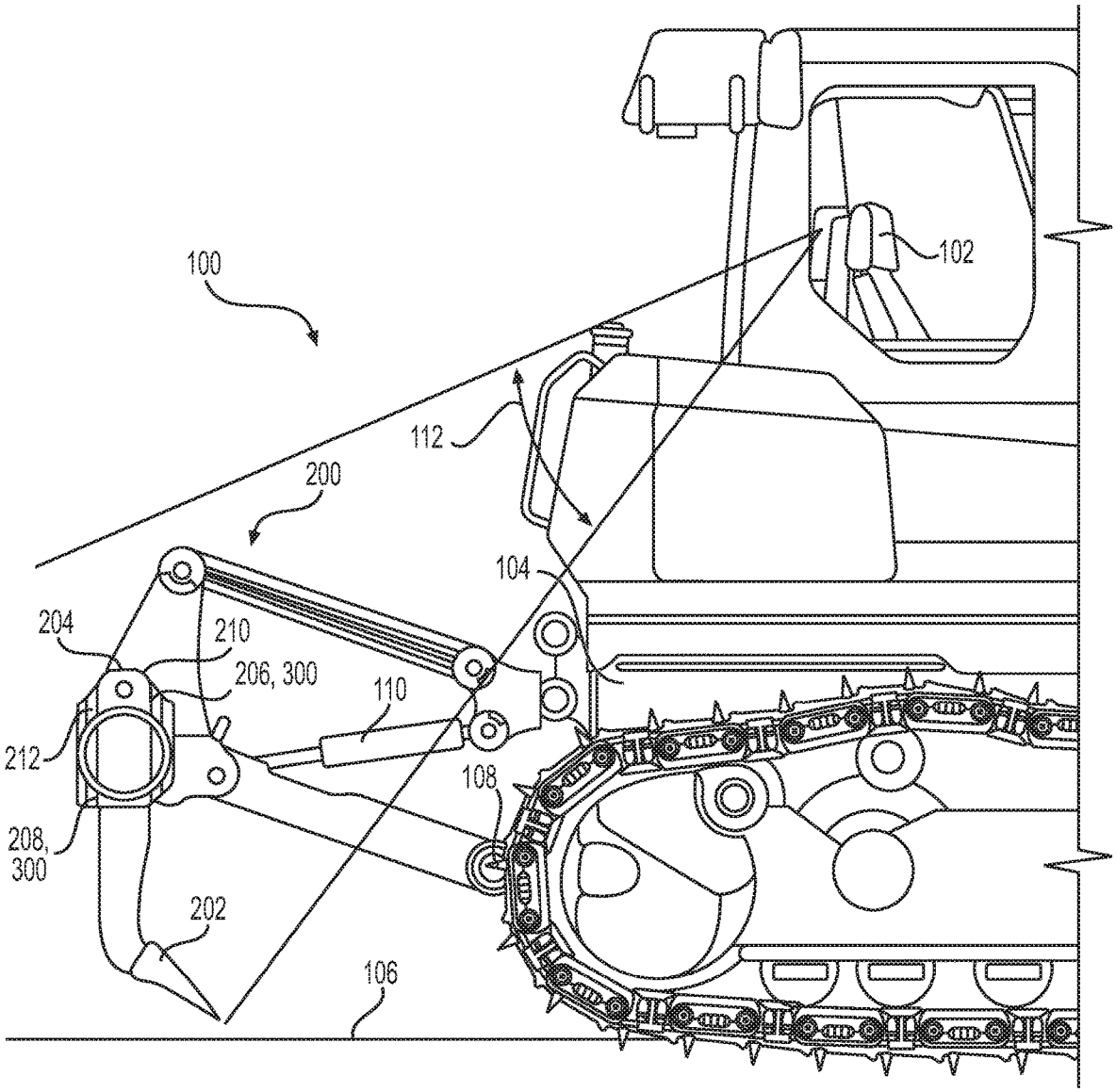
FIG. 1 is a side-view of a machine such as a bulldozer or the like that uses a ripper assembly including a ripper shank pocket with wear inserts according to various embodiments of the present disclosure.

Reference will now be made in detail to embodiments of the disclosure, examples of which are illustrated in the accompanying drawings. Wherever possible, the same reference numbers will be used throughout the drawings to refer to the same or like parts. In some cases, a reference number will be indicated in this specification and the drawings will show the reference number followed by a letter for example, 100a, 100b or by a prime for example, 100', 100" etc. It is to be understood that the use of letters or primes immediately after a reference number indicates that these features are similarly shaped and have similar function as is often the case when geometry is mirrored about a plane of symmetry. For ease of explanation in this specification, letters and primes will often not be included herein but may be shown in the drawings to indicate duplications of features, having similar or identical function or geometry, discussed within this written specification.

Various embodiments of an apparatus and a method for providing wear inserts into a ripper shank pocket of a ripper assembly will now be described. In some embodiments, the ripper shank pocket has a particular configuration. In other embodiments, the wear insert(s) designed to be inserted into the ripper shank pocket and retained therein using a retention mechanism will be discussed. Other configurations for either the ripper assembly, the ripper shank pocket, the ripper cross member, wear insert(s) etc. are possible other than what is specifically shown in the figures of the present application.

FIG. 1 shows an embodiment of a tracked machine 100 in the form of a bulldozer that includes an embodiment of a ripper assembly 200 constructed in accordance with principles of the present disclosure. Among other uses, a ripper assembly may be used to break up ground or other work material.

While the arrangement is illustrated in connection with a bulldozer, the arrangement disclosed herein has universal applicability in various other types of machines commonly used in the construction, mining or earthmoving industries. The term "machine" may refer to any machine that performs some type of operation associated with an industry such as mining, earth moving or construction, or any other industry known in the art. For example, the machine may be an excavator, wheel loader, bulldozer, grader, etc. Moreover, one or more implements may be connected to the machine. Such implements may be utilized for a variety of tasks, including, for example, manipulating a work material such as the ground, dirt, etc.

With continued reference to FIG. 1, an initial penetration view of the ripper tip 202 along a line of sight 112 from the operator cab 102 of a machine 100 using a track undercarriage 104 when the ripper assembly 200 is between a raised position and a dig position, and ripper tip 202 is at the ground penetration level 106. Thus, the operator can see the ripper shank 204 and most, if not all, of ripper tip 202 without obstruction from other parts of ripper assembly 200. This gives the operator better direct visual feedback when initiating a ripping operation. To initiate the ripping operation, the ripper assembly 200 is lowered about a pivot point 108 via hydraulic cylinder(s) 110 until the ripper tip 202 engages the ground penetration level 106. As the ripper tip 202 engages the ground, reactive forces are concentrated at the front top portion 206 and rear bottom portion 208 of the ripper shank pocket 210, disposed in an upwardly extending channel 212 connected to the ripper cross-member 214 (best seen in FIG. 2), where the ripper shank 204 pushes on the walls forming the pocket 210. Wear inserts 300 may be provided at the front top portion 206 and rear bottom portion 208 of the ripper shank pocket 210. The wear inserts may be provided at only the front top portion, at only the rear bottom portion, in the front top and front bottom portions as well as the rear bottom and rear top portions simultaneously, or any suitable combination of these positions, etc.

Figure 2:
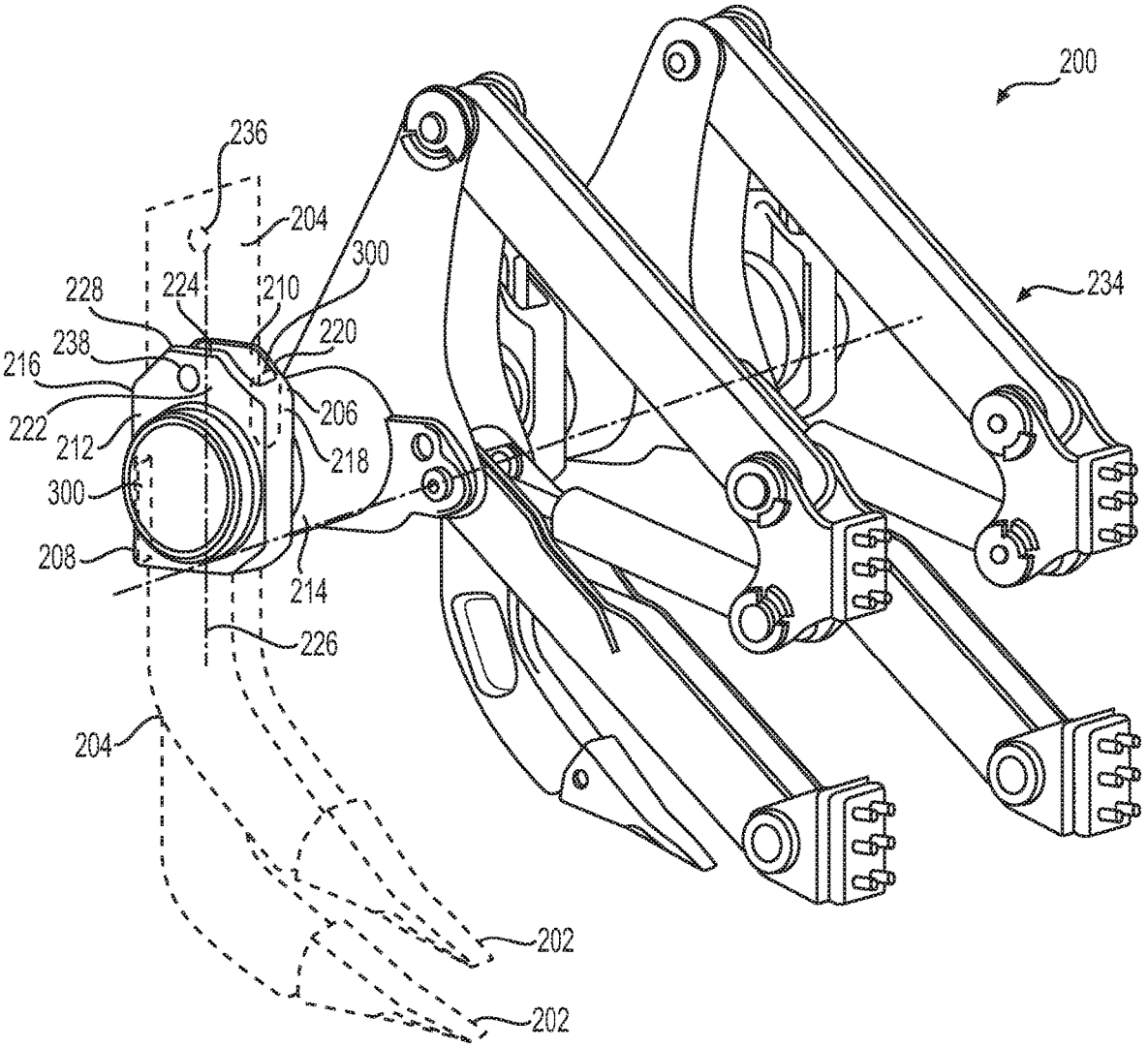
FIG. 2 is a perspective view of a portion of the ripper assembly of FIG. 1 removed from the machine, showing the ripper shank pocket with enhanced clarity.
Figure 3:
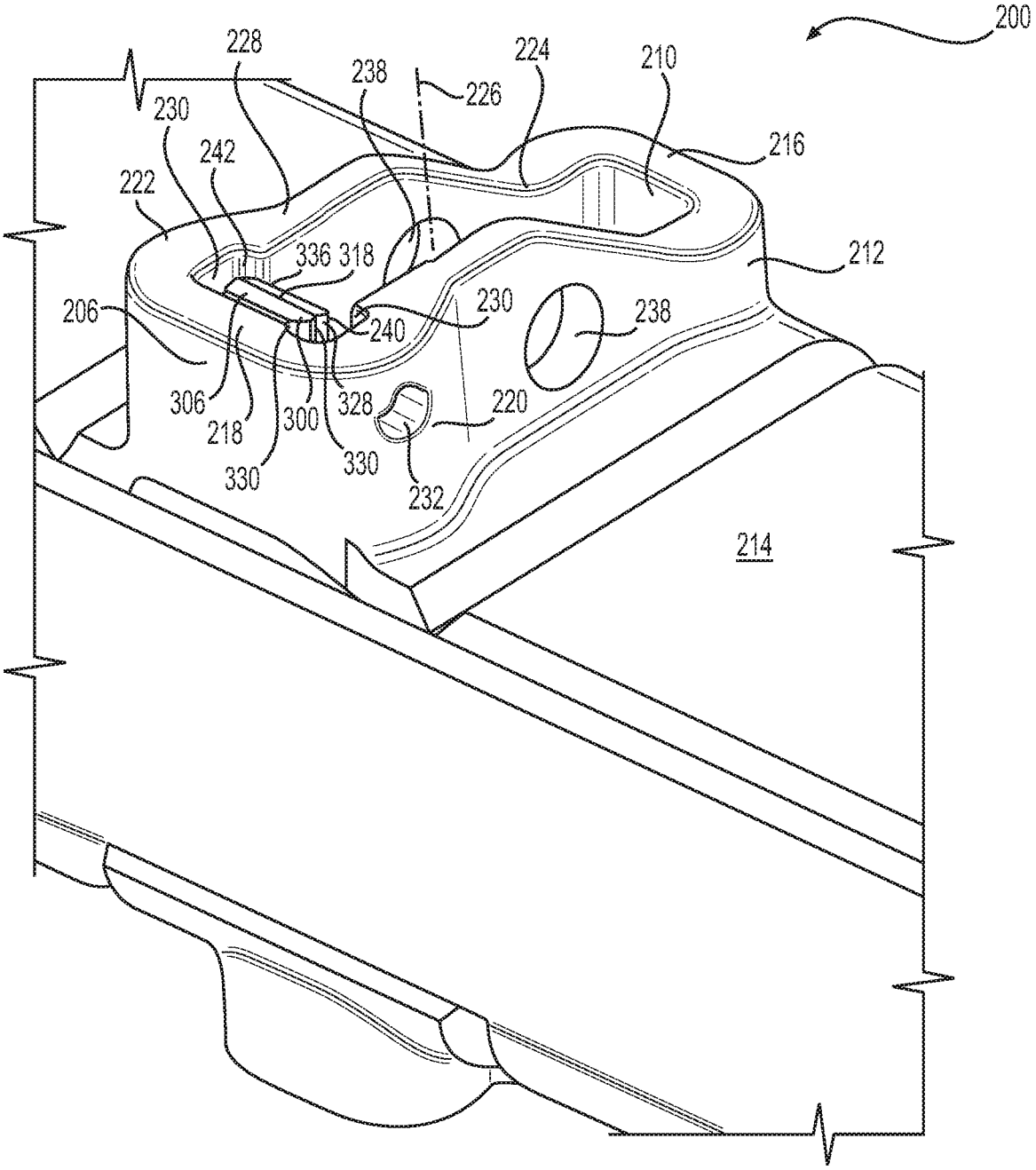
FIG. 3 is a perspective view of a ripper shank pocket of a ripper assembly similar to that shown in FIG. 2 that may have wear inserts inserted therein and held in place using retention mechanisms disposed on the side of the pocket according to various embodiments of the present disclosure.

Looking at FIGS. 2 and 3, it can be seen that the ripper assembly 200 according to an embodiment of the present disclosure may comprises a ripper cross-member 214 defining at least a first ripper shank pocket 210, the ripper cross-member 214 including a front wall 216, a rear wall 218, a first side wall 220 and a second side wall 222 connecting the front wall 216 to the rear wall 218, defining the perimeter 224 of the at least first ripper shank pocket 210, the front wall 216, the rear wall 218, the first side wall 220, and the second side wall 222 also defining a longitudinal axis 226 (so called at its the axis of elongation) and a free end 228 disposed along the longitudinal axis 226 adjacent the perimeter 224 of the at least first ripper shank pocket 210. At least one of the front wall 216, the rear wall 218, the first side wall 220 and the second side wall 222 defining a retention boss aperture 230 and a retention mechanism pocket 232.

It should be noted that FIG. 2 is showing the front top portion 206 of the pocket 210. It is to be understood that a similarly or identically configuration may be provided at the rear bottom portion 208 of the pocket 210. The term "top" is then a reference to the location where a wear insert 300 may be inserted, regardless of whether it is the front top portion 206 or the rear bottom portion 208, or the front bottom portion or the rear top portion, etc. Similarly, the rear wall 218 is the wall providing support to the wear insert 300 regardless of whether it is the front top portion 206 or the rear bottom portion 208, etc. The ripper assemblies 200 shown in FIGS. 2 and 3 are slightly differently configured compared to each other, showing the versatility of the various embodiments of the present disclosure as they are not limited to any particular configuration.

The ripper assembly 200 includes an articulated set of linkages 234 and hydraulic cylinders 110 for moving the ripper assembly 200 up and down, as alluded to previously. Also, the insertion of the ripper shank 204 into the channel 212 such that an attachment aperture 236 of the ripper shank 204 is aligned with the attachment aperture 238 of the channel 212, allowing a pin (not shown) or the like to hold the ripper shank 204 in place relative to the channel 212, is illustrated.

Figure 4:
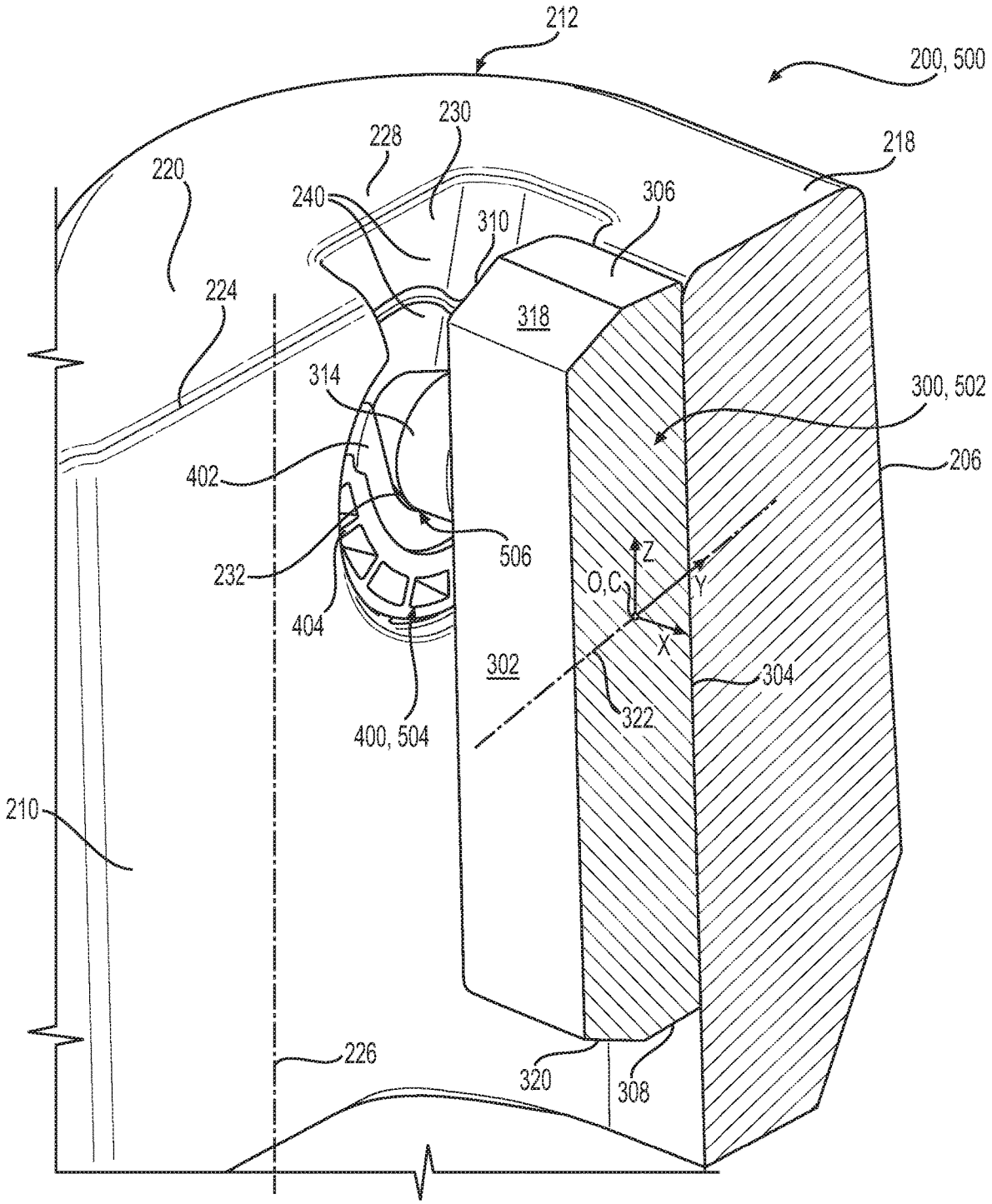
FIG. 4 is an enlarged sectional view of the ripper shank pocket of FIG. 3 shown in a different orientation, illustrating a retention boss of a wear insert seated in a retention mechanism according to a first embodiment of the present disclosure.
Figure 6:
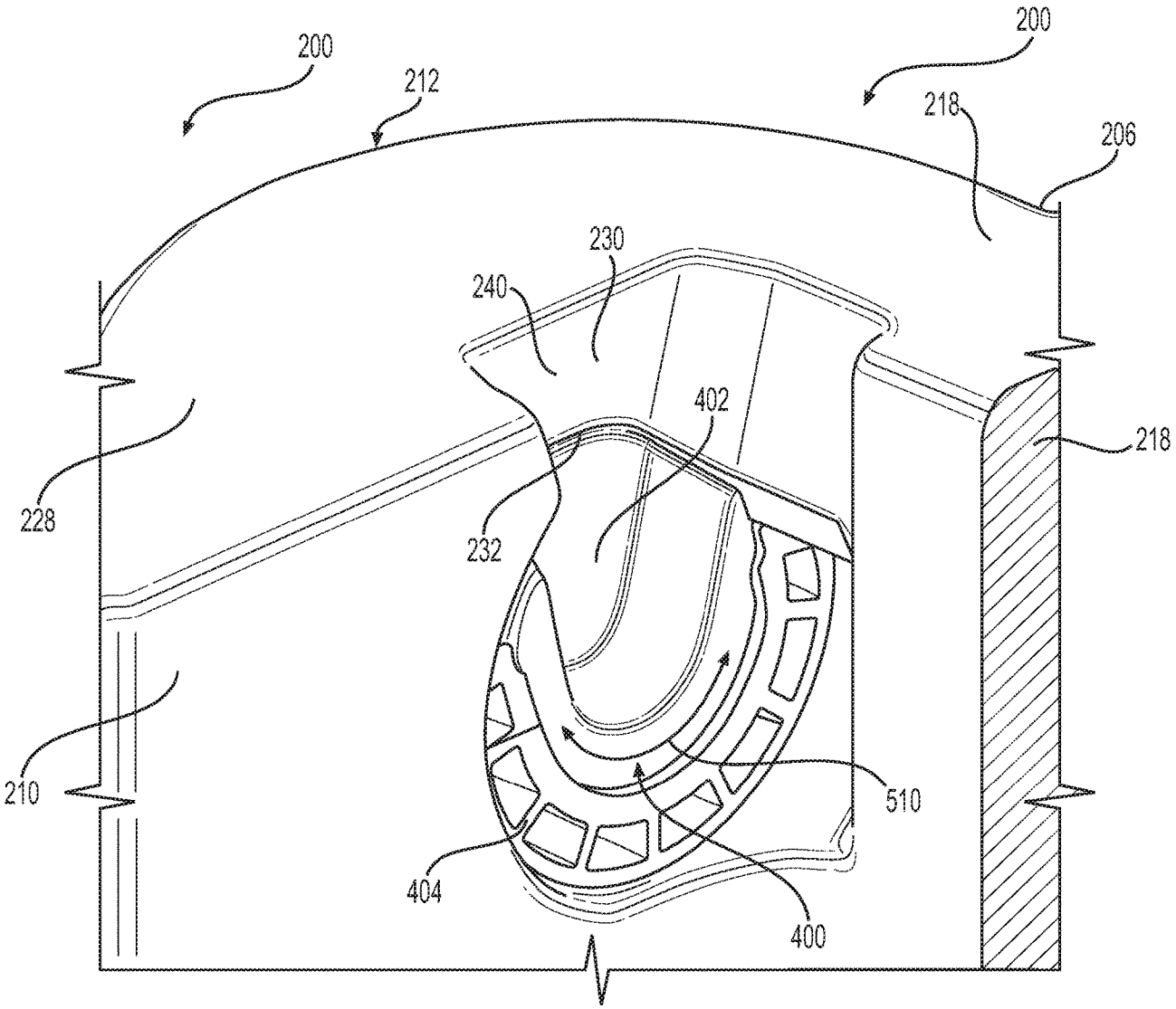
FIG. 6 is an enlarged perspective view of retention mechanism used in the ripper shank pocket of FIG. 4 with the wear insert removed for enhanced clarity.

Focusing on FIGS. 3, 4 and 6, the retention boss aperture 230 may include a first slot 240 extending axially (along the longitudinal axis 226) from the free end 228 to the retention mechanism pocket 232. The first slot 240 and the retention mechanism pocket 232 may be disposed on the first side wall 220 and may be in communication with each other. Given the size of the retention mechanism pocket 232, any retention boss aperture 230 may be configured to bleed onto the rear wall 218 (see FIG. 4).

Figure 5:
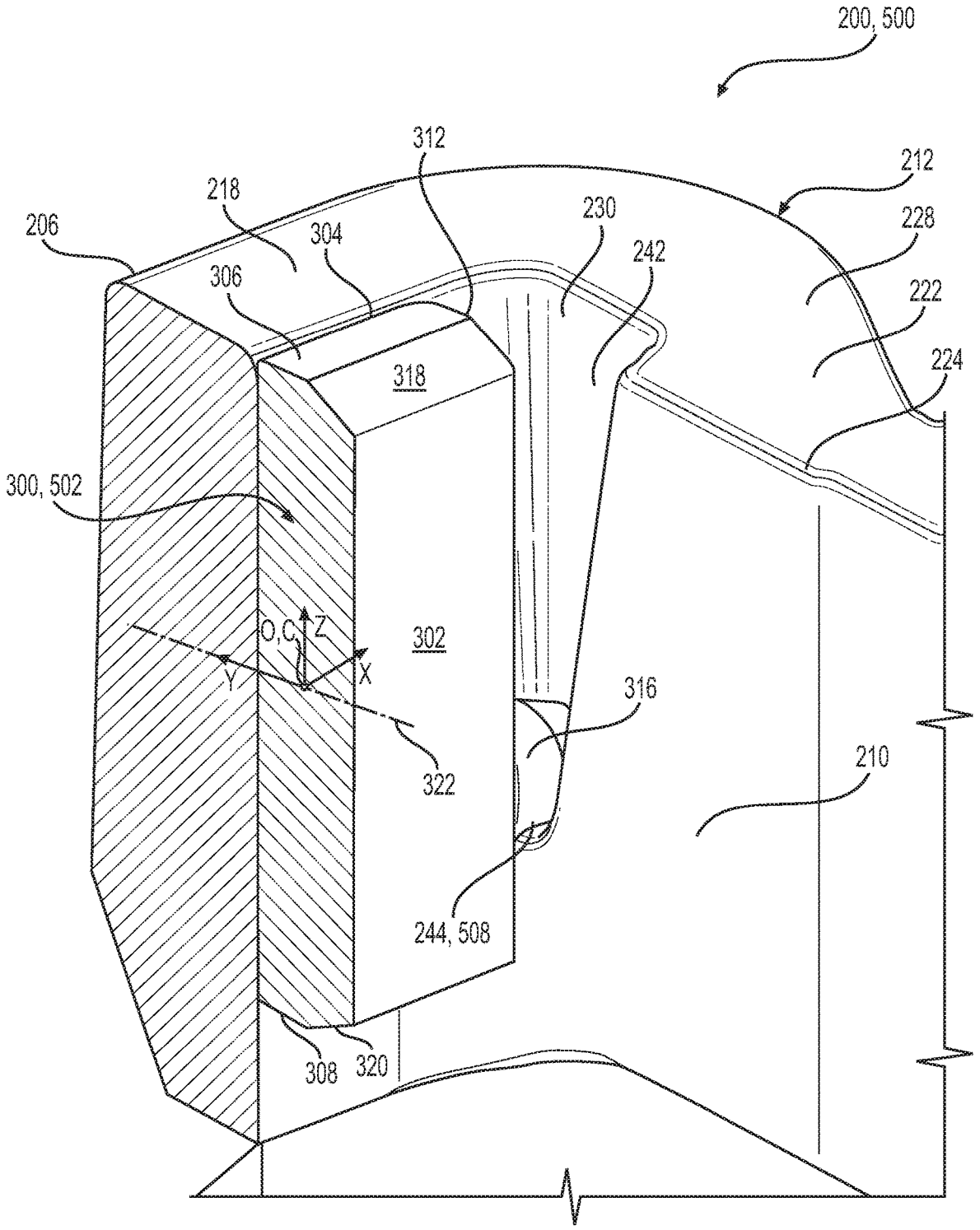
FIG. 5 is an enlarged section view of the ripper shank pocket of FIG. 4 shown in a second orientation, illustrating the other retention boss of the wear insert seated in the bottom of a groove.

Similarly, as best seen in FIG. 5, the second side wall 222 may define a second slot 242 that extends axially further than the first slot 240 and that defines a bottom 244. The second slot 242 does not bleed onto the rear wall 218 since a retention mechanism pocket 232 is not provided for in this embodiment but could be present in other embodiments.

Figure 7:
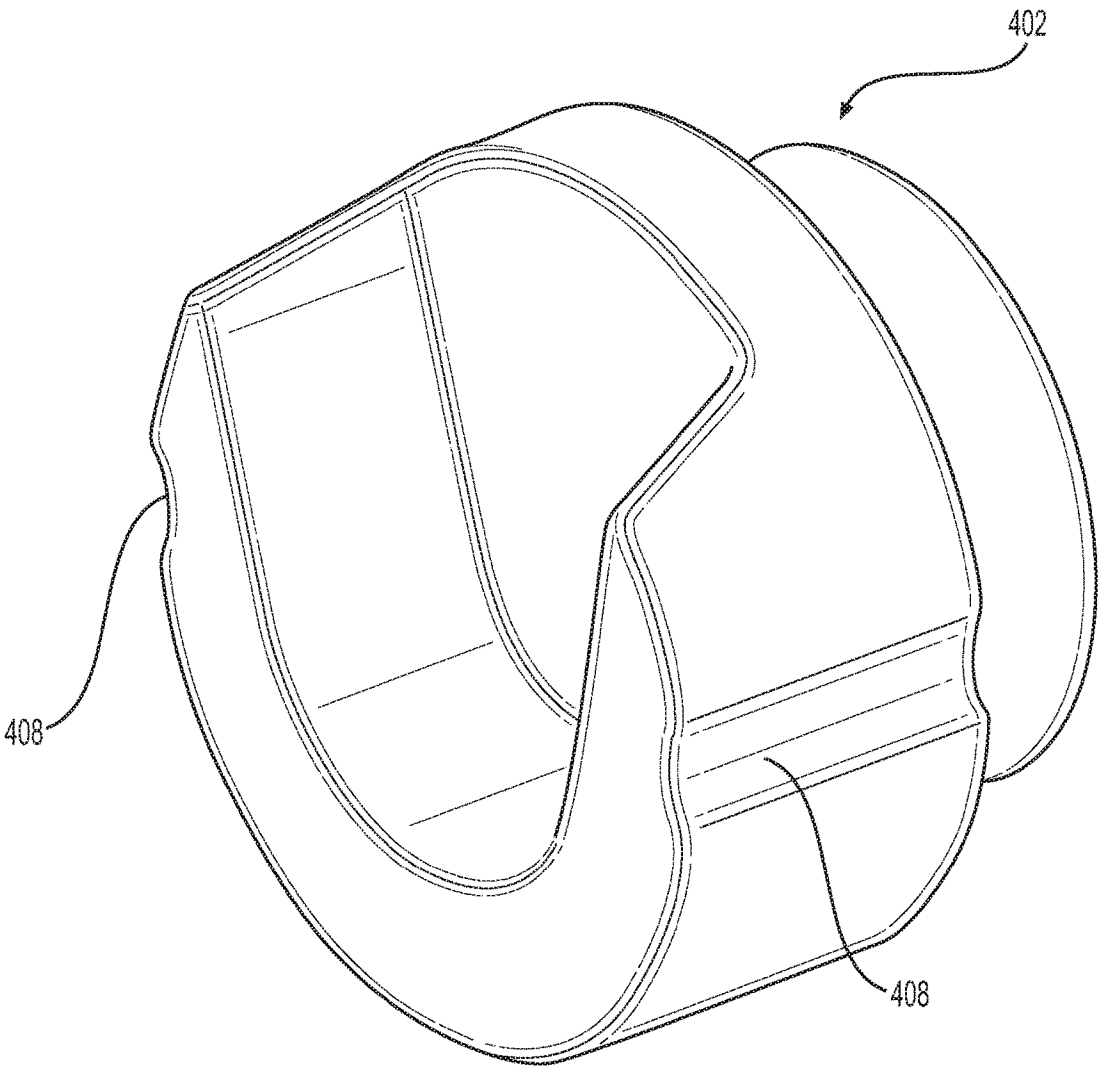
FIG. 7 is a rear oriented perspective view of the lock member of the retention mechanism of FIG. 4 shown in isolation.

Referring to FIGS. 4 and 6, the ripper assembly 200 may further comprise a retention mechanism 400 that is configured to fit within the retention mechanism pocket 232. Once assembled, the retention mechanism 400 is disposed in retaining mechanism pocket 232 and includes a lock member 402 and a retaining bushing 404 (see also FIGS. 7 thru 9) disposed between the lock member 402 and the first side wall 220. The retention mechanism 400 may take any suitable form. In particular embodiments, the retaining mechanism 400 may be the same as that sold under the TRADENAME of CAPSURE by the assignee of the present disclosure. The retaining bushing 404 may be made from polyurethane, or any other suitable material such as other thermoplastics or thermoset materials. The lock member 402 may be made from cast steel, cast iron, grey cast iron or any other suitable material.

Looking now at FIGS. 3, 4, 5, and 10, a wear insert 300 that is configured to fit within the at least first ripper shank pocket 210 will now be discussed. The wear insert 300 may include a front surface 302, a rear surface 304, a top surface 306, a bottom surface 308, a first side surface 310, a second side surface 312, a first retention boss 314 extending from the first side surface 310, and a second retention boss 318 extending from the second side surface 312. In some embodiments, only a first retention boss 314 may be provided.

As best understood with reference to FIG. 4, the wear insert 300 may be disposed in the at least first ripper shank pocket 210 after inserting the wear insert 300 along the longitudinal axis 226. The first retention boss 314 is then seated in the lock member 402 of the retention mechanism 400. The lock member 402 may then be rotated 180 degrees so that the first retention boss 314 is captured, preventing upward movement of the wear insert 300. The lock member 402 is held in either the unlocked or locked configuration when the male detent portion 406 of the retaining bushing 404 engages the female detent portion 408 of the lock member 402 (see FIGS. 7 thru 8). It is to be understood that two male detent portions 406 and two female detent portions 408 may be provided. Looking at FIG. 5, the second retention boss 316 may be seated at the bottom 244 of the second slot 242. In some embodiments, another retention mechanism may be provided to hold onto the second retention boss.

Looking again at FIGS. 3, 4, 5, and 10, the wear insert 300 may include a first blend surface 318 connecting the top surface 306 to the front surface 302, a second blend surface 320 connecting the bottom surface 308 to the front surface 302. Either blend surface may comprise any suitable transitional geometry such as a radius, a chamfer, etc. Only a first blend surface 318 or no blend surfaces may be provided in some embodiments. The wear insert 300 may be configured such that the wear insert 300 defines a rotational axis 322 about which the wear insert 300 may be rotated so that the initial position of the first retention boss 314 becomes the new position of the second retention boss 316, and the initial position of the second retention boss 316 becomes the new position of the first retention boss 314. This may provide added versatility for assembly. The first blend surface 318 may help guide the ripper shank 204 as it is inserted into the ripper shank pocket 210 or as the ripper shank 204 approaches the wear insert 300 in the ripper shank pocket 210 from underneath, etc. The first blend surface 318 and the second blend surface 320 may also serve the functions of providing wear indicators. As they disappear, the user may be notified that the wear insert needs to be replaced.

Figure 10:
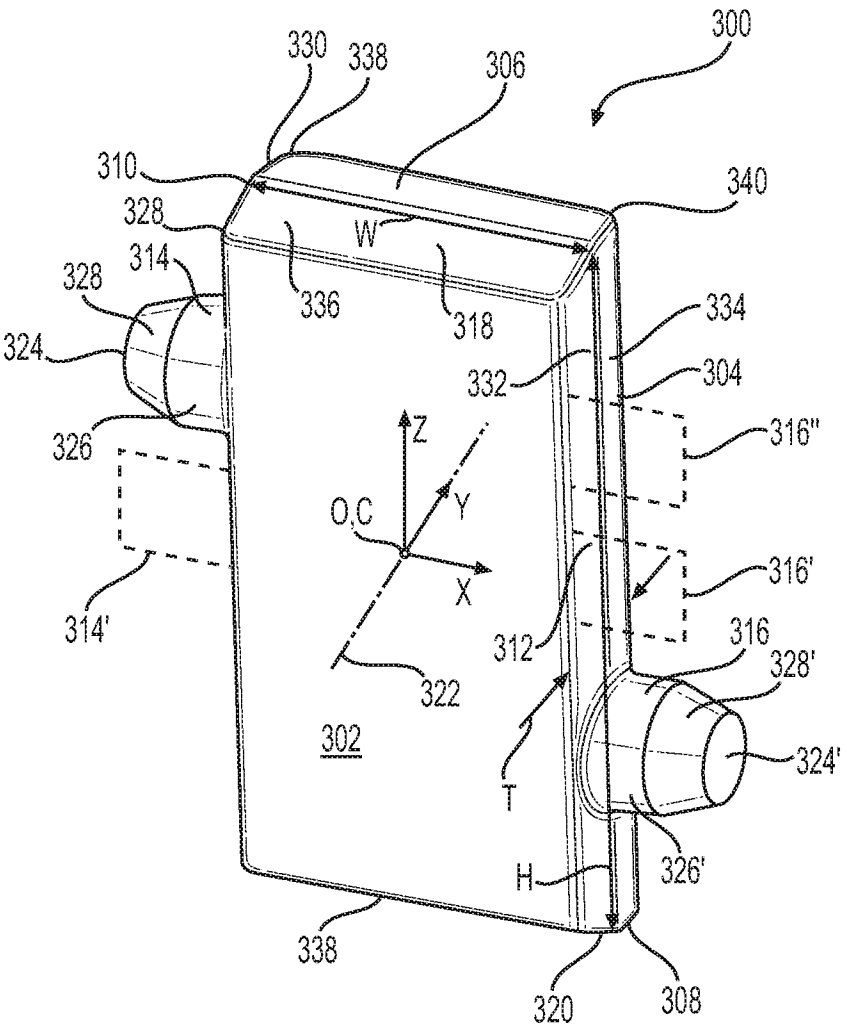
FIG. 10 is a perspective view of the wear insert shown in FIGS. 4 and 5.

Put another way, the wear insert 300 may be configured such that a Cartesian coordinate system with an origin O placed at the centroid C (center of mass) of the wear insert 300 may provide one or more planes of symmetry (see FIG. 10). More specifically, any of the embodiments of a wear insert 300 discussed herein may have one, two or three planes of symmetry (e.g. X-Y plane, X-Z plane, Y-Z plane) and one, two, or three axes of rotation (e.g. X axis, Y axis, Z axis) that allow the wear insert 300 to mate properly with the ripper shank pocket 210 and/or otherwise work properly with the ripper assembly 200.

A wear insert 300 according to an embodiment of the present disclosure will now be discussed by itself with reference to FIG. 10 since the wear insert 300 may be provided as a replacement part. The wear insert 300 may comprise a front surface 302, a rear surface 304, a top surface 306, a bottom surface 308, a first side surface 310, a second side surface 312, a first retention boss 314, and a first blend surface 318 connecting the top surface 306 to the front surface 302. The first blend surface may have any suitable transitional geometry such as a chamfer, radius, etc.

In some embodiment, the wear insert 300 may further comprise a second retention boss 316 and a second blend surface 320 connecting the bottom surface 308 to the front surface 302. The second retention boss 316 and second blend surface 320 may be configured such that the wear insert 300 may be rotated and used in at least two orientations. More particularly, the wear insert 300 may be configured such that the wear insert 300 defines a rotational axis 322 about which the wear insert 300 may be rotated so that the initial position of the first retention boss 314 becomes the new position of the second retention boss 316, and the initial position of the second retention boss 316 becomes the new position of the first retention boss 314.

The first retention boss 314 may be positioned anywhere along the first side surface 310 and the second retention boss 316 may be positioned anywhere along the second side surface 312. For example, the second boss 316" may be collinear with the first boss 314. Alternatively, the first retention boss 314' and the second retention boss 316' may be concentric about the X-axis. Other configurations are possible.

As depicted in FIG. 10, the first retention boss 314 may extend from the first side surface 310 terminating at a free end 324, and the second retention boss 316 may extend from the second side surface 312 terminating at a free end 324', and the first and the second retention bosses 314, 316 have the same configuration including a cylindrical portion 326, 326' connecting to the side surface and a conical portion 328, 328' at the free end 324, 324'. This facilitates the rotation of the wear insert 300 previously alluded to herein. However, it is also contemplated that the first and the second retention bosses 314, 316 may be differently configured from each other so that that they mate with differently configured retention boss apertures 230 (see FIGS. 3, 4 and 5). This may help foolproof assembly of the wear insert 300 into a ripper shank pocket 210 so that any blend surface 318, 320 is in its proper orientation.

With continued reference to FIGS. 3 and 10, the first side surface 310 includes a first angled surface 328 (e.g. not substantially parallel to the Y-Z plane) disposed adjacent the front surface 302 and a first straight surface 330 (e.g. substantially parallel to the Y-Z plane) disposed adjacent the rear surface 304. Likewise, the second side surface 312 includes a second angled surface 332 disposed adjacent the front surface 302 and a second straight surface 334 disposed adjacent the rear surface 304. For this embodiment, the first side surface 310 and second side surface 312 and their associated features may be symmetrical about the Y-Z plane. This may not be the case in other embodiments.

Still referring to FIGS. 3 and 10, the first blend surface 318 may be a first chamfered surface 336 and the second blend surface 320 may be a second chamfered surface 338. The first blend surface 318 and the second blend surface 320 may be symmetrical about the X-Y plane. Also, the wear insert 300 may further comprise a third blend surface 338

(e.g. a radius) joining the first straight surface 330 to the rear surface 304 and a fourth blend surface 340 joining the second straight surface 334 to the rear surface 304. The third blend surface 338 and fourth blend surface 340 may be symmetrical about the Y-Z plane. Any of the features discussed herein may not be symmetrical to each other about any plane in other embodiments.

A wear insert 300 according to yet another embodiment of the present disclosure will now be discussed by itself with reference to FIG. 10. The wear insert 300 may comprise a front surface 302, a rear surface 304, a top surface 306, a bottom surface 308, a first side surface 310 connecting the front surface 302 to the rear surface 304 and connecting the top surface 306 to the bottom surface 308, a second side surface 312 connecting the front surface 302 to the rear surface 304 and connecting the top surface 306 to the bottom surface 308, and a first retention boss 314 extending from the first side surface 310.

As already mentioned earlier herein, the first retention boss 314 may be located anywhere as desired or needed along the first side surface 310 and may be configured in any desirable or needed manner.

In some embodiments, a second retention boss 316 may extend from the second side surface 312. The second retention boss 316 may be omitted in other embodiments. The wear insert 300 may include a general cubic or rectangular configuration. That is to say, the wear insert 300 may define a thickness T that is the minimum distance (e.g. measured along the Y axis) between the front surface 302 and the rear surface 304, a width W (e.g. measured along the X axis) that is the minimum distance between the first side surface 310 and the second side surface 312, and a height H that is the minimum distance (e.g. measured along the Z axis) between the top surface 306 and the bottom surface 308. The height H may exceed the width W, and the width W may exceed the thickness T.

At least a portion of the top surface 306 may be flat being parallel (e.g. substantially parallel to the X-Z plane) to at least a portion of the bottom surface 308 that is flat. At least a portion of the first side surface 310 may be flat (e.g. substantially parallel to the Y-Z plane) being parallel to at least a portion of the second side surface 312 that is flat. In addition, the at least portion of the first side surface 310 that is flat may be perpendicular to the at least portion of the top surface 306 that is flat (e.g. similar to the X-Z plane being perpendicular to the Y-Z plane) and the at least portion of the first side surface 310 that is flat is perpendicular to the at least portion of the bottom surface 308 that is flat (e.g. similar to the X-Z plane being perpendicular to the Y-Z plane).

Figure 11:
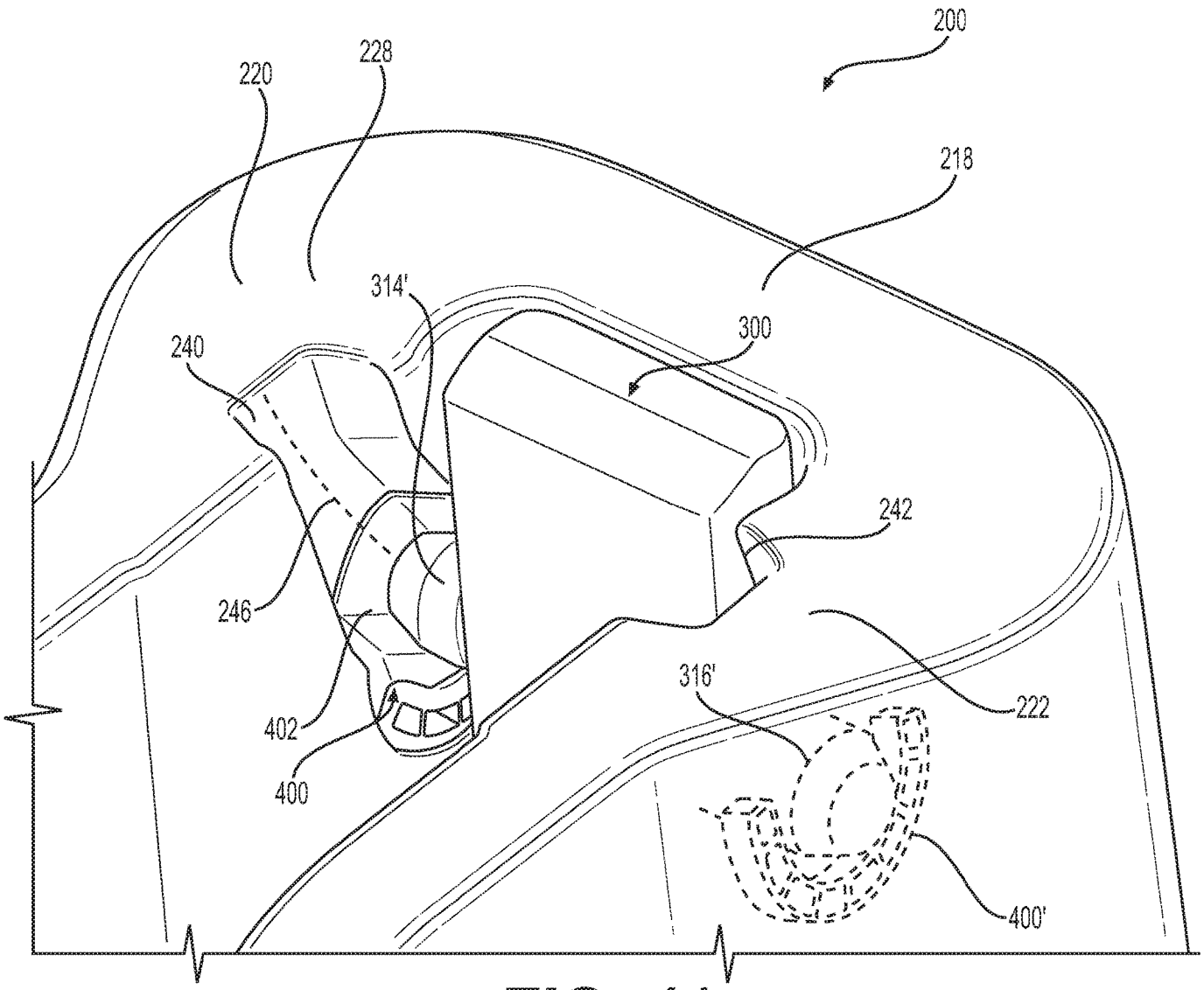
FIG. 11 is a perspective view of another embodiment of a wear insert and ripper shank pocket of the present disclosure.

FIG. 11 illustrates another embodiment of the ripper shank pocket 210 and the wear insert 300 similarly constructed as previously described herein except as following. In this embodiment, the wear insert 300 has a first retention boss 314' and second retention boss 316' positioned as depicted in FIG. 10. Furthermore, two retention mechanisms 400 are employed (only one clearly shown) that are configured as previously described herein. When the first retention boss 314' is seated in the first retention mechanism 400, the second retention boss 316' is also seated in the second retention mechanism 400'. Also, the first side wall 220 and the second side wall 222 and their associated features (e.g. the first slot 240 and the second slot 242) are symmetrical about the Y-Z plane (see FIG. 10) once the wear insert 300 is installed. The first slot 240 and the second slot 242 do not bleed onto the rear wall 218 but are spaced away from the rear wall 218 at the free end 228. The first slot 240 and the second slot 242 define a curved path 246 so that the wear insert 300 is initially spaced away from the rear wall 218 and moves closer to the rear wall 218 as the wear insert 300 seats into the lock member 402. The orientation of the lock member 402 is also different to accommodate the curved path 246 to receive the retention boss 314' properly. That is to say, the mouth of the lock member 402 may not be vertical but oriented at an angle to the vertical direction to receive the retention boss. Once the lock member 402 is rotated, it may provide a force vector that helps to force wear insert 300 against the rear wall 218.

For many embodiments, the wear insert may be cast using iron, grey-iron, steel or other suitable materials. Other manufacturing processes may be used to make the wear inserts such as any type of machining, forging, etc. For example, steel or "tough steel" may be used to create the wear insert. Wear inserts may also be coated, heat treated, etc. to provide suitable characteristics for various applications. The wear insert or any other component discussed herein may be made for a unitary component or may be split into multiple components are form a subassembly, etc. Any of the features discussed herein may omit the small blends shown in the drawings but not specifically mentioned in the written specification and these features may be ignored. Similarly, small draft angles (e.g. less than 5 degrees) may be ignored and/or omitted in various embodiments. Any suitable retention mechanism may be employed to retain the wear insert in the shank ripper pocket. Also, any of the dimensions, configurations, etc. discussed herein may be varied as needed or desired to be different than any value or characteristic specifically mentioned herein.

INDUSTRIAL APPLICABILITY

In practice, a ripper assembly, a wear insert, a ripper cross-member, a retention mechanism, and/or a channel according to any embodiment described herein may be sold, bought, manufactured or otherwise obtained in an OEM or after-market context. In some cases, the wear insert and retention mechanism may be provided as a kit, etc.

Referring now to FIGS. 4 and 5, a method 500 of assembling a ripper assembly 200 may be understood. A wear insert 300 may be provided to which a retention boss 314 is attached or integrally formed therewith (step 502). Then, the wear insert 300 may be inserted downward along the longitudinal axis 226 of a shank ripper pocket 210. In many cases, the retention mechanism 400 may have already been inserted into the retention mechanism pocket 232 and held therein (step 504). As the wear insert is lowered, the first retention boss 314 engages the lock member 402 (step 506). At about the same time, if a second retention boss 316 is provided, then the second retention boss 316 engages or nearly engages the bottom 244 of the second slot 242 (step 508). Then, the lock member is rotated 180 degrees until the lock member is in a locked configuration (step 510 in FIG. 6).

Figure 8:
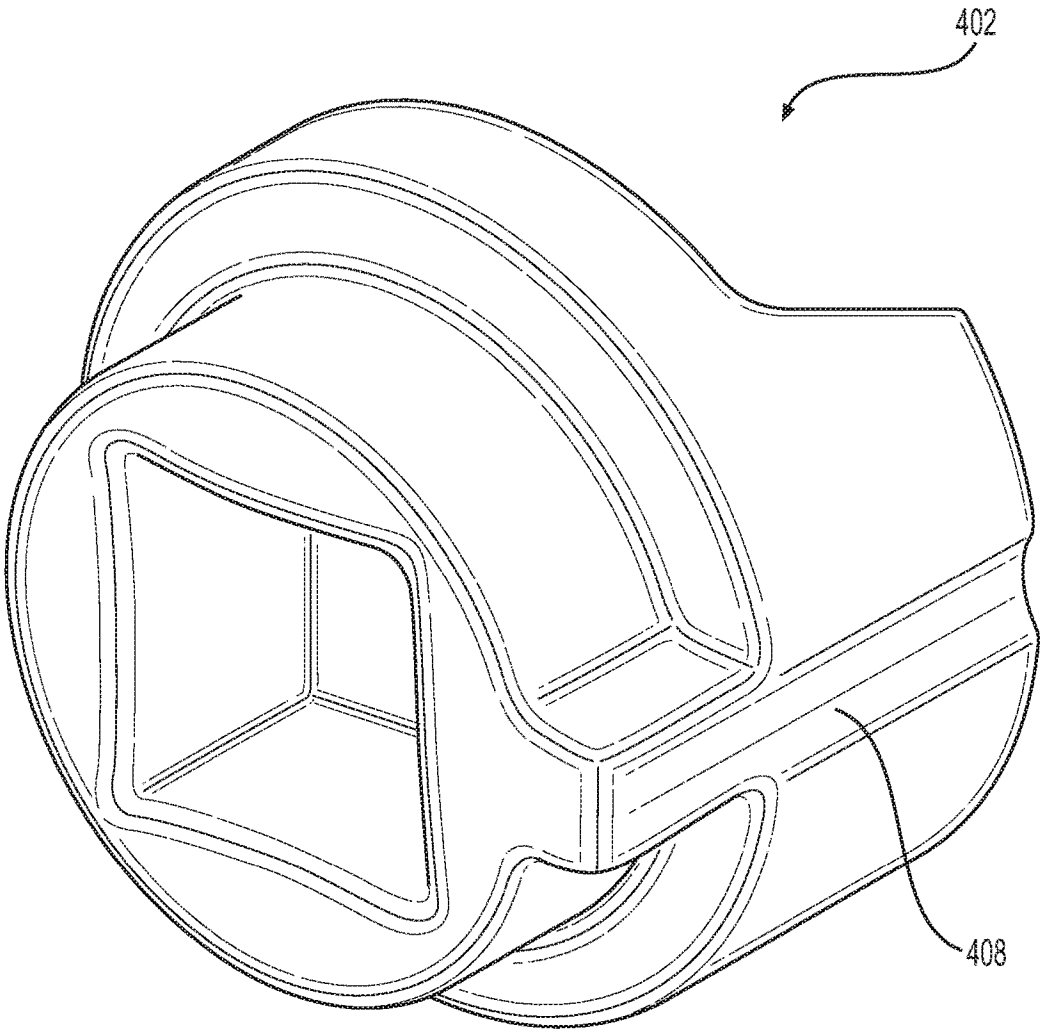
FIG. 8 is a front oriented perspective view of the lock member of the retention mechanism of FIG. 4 shown in isolation.
Figure 9:
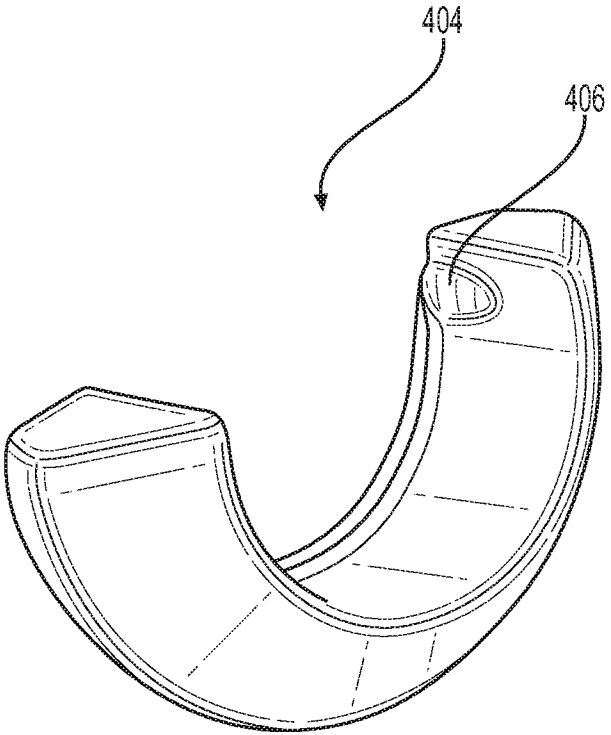
FIG. 9 is a perspective view of a retaining bushing used in the retention mechanism of FIG. 4.

Rotation of the locking member may be achieved by inserting a square shaped drive head of a wrench (not shown) or similar tool into a complimentarily shaped pocket of the lock member (see FIG. 8). Then, the lock member is rotated to achieve the locked configuration. In either extreme position (locked or unlocked configuration), detents 408 on the retaining bushing 404 hold the lock member 402 in position unless sufficient torque is provided to move the locking member to overcome the detent force. This helps to ensure that the wear insert will not fall out of the ripper shank pocket due to vibration, gravity, etc. The locking and unlocking of the retention mechanism is repeated if there are two such retaining mechanisms used to hold the wear insert in place.

While wear inserts that are used to absorb the load exerted on a ripper member has been specifically discussed, it is to be understood that other applications are also considered to be within the scope of the present application. Any of the components or features disclosed herein may be altered compared to what has been specifically described in this specification or shown in the figures as needed or desired.

It will be apparent to those skilled in the art that various modifications and variations can be made to the embodiments of the apparatus and methods of assembly as discussed herein without departing from the scope or spirit of the invention(s). Other embodiments of this disclosure will be apparent to those skilled in the art from consideration of the specification and practice of the various embodiments disclosed herein. For example, some of the equipment may be constructed and function differently than what has been described herein and certain steps of any method may be omitted, performed in an order that is different than what has been specifically mentioned or in some cases performed simultaneously or in sub-steps. Furthermore, variations or modifications to certain aspects or features of various embodiments may be made to create further embodiments and features and aspects of various embodiments may be added to or substituted for other features or aspects of other embodiments in order to provide still further embodiments.

Accordingly, it is intended that the specification and examples be considered as exemplary only, with a true scope and spirit of the invention(s) being indicated by the following claims and their equivalents.

What is claimed is:

1. A ripper assembly comprising:

a ripper cross-member defining at least a first ripper shank pocket, the ripper cross-member including a front wall, a rear wall, a first side wall and a second side wall connecting the front wall to the rear wall, defining a perimeter of the at least first ripper shank pocket, the front wall, the rear wall, the first side wall, and the second side wall also defining a longitudinal axis and a free end disposed along the longitudinal axis adjacent the perimeter of the at least first ripper shank pocket;

at least one of the front wall, the rear wall, the first side wall and the second side wall defining a retention boss aperture and a retention mechanism pocket in communication with the retention boss aperture, wherein the retention boss aperture includes a first slot extending axially from the free end to the retention mechanism pocket, wherein the first slot and the retention mechanism pocket are disposed on the first side wall and the first slot is spaced away from the rear wall at the free end, the first slot defining a curved path, and wherein the second side wall defines a second slot that is symmetrically configured to the first slot;

a first retention mechanism that is configured to fit within the retention mechanism pocket, wherein the first retention mechanism is disposed in retaining mechanism pocket and includes a lock member and a retaining bushing disposed between the lock member and the first side wall; and a wear insert that is configured to fit within the at least first ripper shank pocket, the wear insert including a front surface, a rear surface, a top surface, a bottom surface, a first side surface, a second side surface, a first retention boss extending from the first side surface, and a second retention boss extending from the second side surface.

2. The ripper assembly of claim 1 further comprising a second retention mechanism, wherein the wear insert is disposed in the at least first ripper shank pocket, the first retention boss is seated in the lock member of the first retention mechanism, and the second retention boss is seated in the second retention mechanism.

3. The ripper assembly of claim 2 wherein the wear insert includes a first blend surface connecting the top surface to the front surface, a second blend surface connecting the bottom surface to the front surface, and is configured such that the wear insert defines a rotational axis about which the wear insert may be rotated so that the initial position of the first retention boss becomes the new position of the second retention boss, and the initial position of the second retention boss becomes the new position of the first retention boss.

4. A wear insert comprising:

a front surface;

a rear surface;

a top surface;

a bottom surface;

a first side surface;

a second side surface;

a first retention boss;

a first blend surface connecting the top surface to the front surface; and a second retention boss and a second blend surface connecting the bottom surface to the front surface, wherein the wear insert is configured such that the wear insert defines a rotational axis about which the wear insert may be rotated so that the initial position of the first retention boss becomes the new position of the second retention boss, and the initial position of the second retention boss becomes the new position of the first retention boss.

5. The wear insert of claim 4 wherein the first retention boss extends from the first side surface terminating at a free end, and the second retention boss extends from the second side surface terminating at a free end, and the first and the second retention bosses have the same configuration including a cylindrical portion connecting to the wear insert and a conical portion at the free end.

6. The wear insert of claim 4 wherein the first side surface includes a first angled surface disposed adjacent the front surface and a first straight surface disposed adjacent the rear surface and the second side surface includes a second angled surface disposed adjacent the front surface and a second straight surface disposed adjacent the rear surface.

7. The wear insert of claim 4 wherein the first blend surface is a first chamfered surface, the second blend surface is a second chamfered surface, and the wear insert further comprises a third blend surface joining the first straight surface to the rear surface and a fourth blend surface joining the second straight surface to the rear surface.

8. A wear insert comprising:

a front surface;

a rear surface;

a top surface;

a bottom surface;

a first side surface connecting the front surface to the rear surface and connecting the top surface to the bottom surface;

a second side surface connecting the front surface to the rear surface and connecting the top surface to the bottom surface;

a first retention boss extending from the first side surface;

a second retention boss extending from the second side surface, wherein the wear insert defines a thickness that is the minimum distance between the front surface and the rear surface, a width that is the minimum distance between the first side surface and the second side surface, and a height that is the minimum distance between the top surface and the bottom surface, the height exceeds the width, and the width exceeds the thickness;

a first blend surface connecting the top surface to the front surface, and a second blend surface connecting the bottom surface to the front surface; and a third blend joining the first side surface to the rear surface and a fourth blend joining the second side surface to the rear surface.

9. The wear insert of claim 8 wherein at least a portion of the top surface is flat being parallel to at least a portion of the bottom surface that is flat, at least a portion of the first side surface is flat being parallel to at least a portion of the second side surface that is flat.

10. The wear insert of claim 9 wherein the at least portion of the first side surface that is flat is perpendicular to the at least portion of the top surface that is flat, and the at least portion of the flat side surface that is flat is perpendicular to the at least portion of the bottom surface that is flat.

* * * * *